US008304155B2

(12) United States Patent
Tyagi et al.

(10) Patent No.: US 8,304,155 B2
(45) Date of Patent: Nov. 6, 2012

(54) TONER COMPOSITION FOR PREVENTING IMAGE BLOCKING

(75) Inventors: Dinesh Tyagi, Fairport, NY (US); Walter B. Sherwood, Rochester, NY (US); Louise Granica, Victor, NY (US)

(73) Assignee: Eastman Kodak Company, Rochester, NY (US)

( * ) Notice: Subject to any disclaimer, the term of this patent is extended or adjusted under 35 U.S.C. 154(b) by 706 days.

(21) Appl. No.: 12/434,736

(22) Filed: May 4, 2009

(65) Prior Publication Data

US 2009/0297970 A1 Dec. 3, 2009

Related U.S. Application Data

(60) Provisional application No. 61/056,948, filed on May 29, 2008.

(51) Int. Cl.
*G03G 9/08* (2006.01)
*G03G 9/087* (2006.01)

(52) U.S. Cl. ..... 430/108.1; 430/108.8; 430/109.1

(58) Field of Classification Search ..... 430/108.1, 430/108.8, 109.1
See application file for complete search history.

(56) References Cited

U.S. PATENT DOCUMENTS

| | | | | |
|---|---|---|---|---|
| 5,494,768 | A | 2/1996 | Boswell et al. | |
| 5,702,852 | A | 12/1997 | May et al. | |
| 5,783,348 | A | 7/1998 | Tyagi et al. | |
| 6,156,473 | A | 12/2000 | Tyagi et al. | |
| 2003/0027955 | A1 * | 2/2003 | Ishii et al. | 526/127 |
| 2005/0025540 | A1 | 2/2005 | Murai et al. | |
| 2007/0280760 | A1 * | 12/2007 | Nishikata et al. | 399/341 |
| 2009/0142677 | A1 * | 6/2009 | Shitara et al. | 430/48 |

FOREIGN PATENT DOCUMENTS

EP 2 065 757 A1 6/2009

* cited by examiner

*Primary Examiner* — Hoa V Le
(74) *Attorney, Agent, or Firm* — Andrew J. Anderson

(57) ABSTRACT

Images produced by electrophotography are often subjected to harsh conditions, such as high temperature and high relative humidity conditions. Prints when subjected to face-to-face stacking under these conditions tend to stick and are difficult to separate without damage. Ethylene-bis-stearamide is incorporated in a protective toner formulation employing a toner binder having a higher glass transition temperature than that of the conventional CYMK colored image toners employed to provide a protective layer in fused images. Further, ethylene-bis-stearamide does not interfere with typical oil release additives used in fuser rollers. By combining ethylene-bis-stearamide with polyalkane waxes having a weight average molecular weight of equal to or greater than 2000 and a poly dispersity of less than 2.0, addition protection can be realized.

18 Claims, 3 Drawing Sheets

TONER COMPOSITION FOR PREVENTING IMAGE BLOCKING

CROSS-REFERENCE TO RELATED APPLICATIONS

This is a 111A application of Provisional Application Ser. No. 61/056,948, filed May 29, 2008.

FIELD OF THE INVENTION

This invention relates in general to toner and developer useful for electrographic printing, and more particularly to protective toner composition that helps prevent images and prints, produced via electrophotography, from sticking and blocking when subjected to elevated temperature and relative humidity conditions.

BACKGROUND OF THE INVENTION

One common method for printing images on a receiver member is referred to as electrography (also referred to as electrostatography). In this method, an electrostatic image may be formed on a dielectric member by uniformly charging the dielectric member and then discharging selected areas of the uniform charge to yield an image-wise electrostatic charge pattern. Such discharge is typically accomplished by exposing the uniformly charged dielectric member to actinic radiation provided by selectively activating particular light sources in an LED array or a laser device directed at the dielectric member (this embodiment is typically referred to as electrophotography). Alternatively, the image-wise electrostatic charge pattern may be formed directly on a chargeable member. After the image-wise charge pattern is formed, the pigmented (or in some instances, non-pigmented) marking particles, or toner, are given a charge, substantially opposite the charge pattern on the dielectric member and brought into the vicinity of the dielectric member so as to be attracted to the image-wise charge pattern to develop such pattern into a visible image.

Thereafter, a suitable receiver member (e.g., cut sheet of plain bond paper) is brought into juxtaposition with the marking particle developed image-wise charge pattern on the dielectric member. A suitable electric field is applied to transfer the marking particles to the receiver member in the image-wise pattern to form the desired print image on the receiver member. The receiver member is then removed from its operative association with the dielectric member and subjected to heat and/or pressure to permanently fix the marking particle print image to the receiver member. Plural marking particle images of, for example, different color particles respectively can be overlaid on one receiver member (before fixing) to form a multi-color print image on the receiver member.

These color printed images produced on electrographic devices have found many usage in both and commercial and consumer applications. Initially, the color print was primarily limited to marketing collaterals. However, a combination of sudden transformation of photography to digital format and improvements made in the quality of digital printing has placed additional constraints on electrophotographic prints that were not applicable for outputs from copiers. For example, it is not uncommon for consumers to have a photo albums printed using electrophotographic printers and use them in a manner they are accustomed to with traditional silver halide output. Examples of such cases would include leaving albums in the car on a hot humid day as well as leaving pictures and images in an attic where high temperatures and high humidity conditions often prevail.

As mentioned previously, a developed electrophotographic image on a substrate has to be fixed or fused before it can be properly handled. This requires a certain amount of melt flow of the toner when its temperature is increased as it is passed thru a fixing device. Examples of such fixing device include, a pair of heated rollers, radiant fusing, flash fusing, microwave fusing and the like. In all such cases, the melt flow of the toner should take place as quickly as possible upon heating. This can be achieved by selecting a low softening or glass transition temperature (Tg) of the toner binder and keeping molecular weight of the binder as low as possible. If the Tg of the toner binder is too high, then adequate polymer flow, necessary for proper fixing not achieved. Alternatively, higher Tg binder toners require a much higher fusing conditions, where the paper handling and life of the fuser rollers is drastically reduced. On the other hand, if the glass transition temperature of the toner is too low, then toner particles can fuse together either during shipping or inside a electrographic printers where the temperature is higher than the ambient. For this reason, useful range of the glass transition temperature for toner binder is typically limited to below 60° C., and typically from about 50 to less than 60° C. Also, when molecular weight of the toner polymer is too low, the toner tends to get very brittle which adversely affects the developer life and print physicals.

When electrographic images made with the toner binder as described above is subjected to high temperature, then print sticking becomes a common occurrence. During summer months, temperature of 55° C. and higher can be easily achieved in vehicles parked in the sun or in an attic. It is not very uncommon to have prints exposed to such condition as a result. With some polymers, relative humidity also becomes a critical factor. The reason for this is that many polymer binders are plasticized by moisture present in the atmosphere. Polyester, which is the most common type of toner binder used in the industry, is one such example of polymer, which can be plasticized by water. When a polymer is plasticized by water, its Tg is depressed by a certain amount proportional to the relative humidity in the atmosphere. As a consequence, a set of prints or a photo album can exhibit signs of sticking or "bricking" or "blocking" when they are subjected to such extreme temperature and relative humidity conditions. Such damage is irreversible and renders the prints useless. It is, therefore, highly desirable to have prints that can survive these extreme conditions.

Use of waxes and various other toner additives to improve fusing and other toner properties is known in the art. U.S. Pat. No. 5,783,348, e.g., discloses use of aliphatic amides and aliphatic acids as additives for providing low surface energy toners. U.S. Pat. No. 5,702,852 discloses use of aliphatic amide and aliphatic acids in non-marking toner to improve abrasion resistance. There is no suggestion in the prior art that use of selected aliphatic amides in a protective toner would uniquely improve blocking performance.

SUMMARY OF THE INVENTION

A feature of the present invention is to provide an electrophotographic toner, which is capable of resisting print sticking at relatively high temperature and humidity conditions, such as 55° C. and 95% relative humidity for a 24 hours exposure.

A further feature of the present invention is to provide an electrophotographic toner formulation that provides print sticking resistance at the above stated conditions and yet provides satisfactory charge and/or flow properties.

Another feature of the present invention is to provide an electrophotographic toner, which provides improved print sticking resistance and yet does not affect the release fluid used in a contact roller fusing method.

Another feature of the present invention is to provide a two component developer which can be used in an electrophotographic printer to provide a protective overcoat in either a uniform manner or a selective manner depending on the image content and the desired level of protection.

Additional features and advantages of the present invention will be set forth in part in the description which follows, and in part will be apparent from the description, or may be learned by practice of the present invention. To achieve these and other advantages and in accordance with the purposes of the present invention as embodied and broadly described herein, the present invention relates to toner particles or a toner formulation containing at least one toner resin and at least one additive.

This invention is directed to toner and developer useful for electrographic printing, and more particularly to a protective toner composition that helps prevent images and prints, produced via electrophotography, from sticking and blocking when subjected to elevated temperature and relative humidity conditions. Such electrographic printing preferably includes the steps of forming a desired print image, electrographically, on a receiver member utilizing cyan, yellow, magenta, and black (CYMK) color marking particles; and in the area of the formed print image, where protection from sticking or blocking is desired, selectively forming a protective toner layer, utilizing a protective toner of this invention whose composition is different from that of the CYMK marking particles of the desired print image. In particular, the protective toner comprises a binder having a higher Tg than that of the color marking material toner binder, and further comprises ethylene-bis-stearamide as an additive. In the preferred embodiment, the protective toner of this invention is clear, i.e., it does not contain pigment and is used over the color image formed with the standard CYMK toners.

In one embodiment, a desired optimum performance is achieved when toner particle of this invention are placed uniformly across the entire color image to provide the protective layer. In such case, a uniform protective layer would be present over the entire image regardless of the image content. The amount of inventive toner required to form the protective layer would be much higher in this case, but the final image has a uniform gloss and feel. In another embodiment, inventive toner is used only where the higher amount of standard color toner is present in the image. This lowers the amount of the inventive toner required for the protection, by placing the toner of this invention only in the darker areas where the typical sticking problem is often observed. In general, the lighter areas of an image do not exhibit print sticking problem as compared with the higher density areas.

It was determined that it is possible to prepare a new toner formulation which is essentially transparent and is capable of providing protection to a standard color image when it is applied uniformly or selectively on top. This is achieved by incorporating a certain amount of ethylene-bis-stearamide (EBS) to the toner formulation whose binder has a glass transition temperature of at least 60° C. It was found quite unexpectedly that EBS migrates to the surface of the image after the image fixing step. Since ethylene-bis-stearamide is completely crystalline, it does not affect the flow properties of the toner as typically what happens when low melting semi-crystalline waxes that are often added to the toner formulation. Further, ethylene-bis-stearamide is not plasticized under high humidity conditions, thereby allowing typical toner binders to be used in this application. Standard CYMK marking particles which comprise a toner binder having a glass transition temperature less than 60° C. and which do not containing any ethylene-bis-stearamide would be underneath the essentially transparent toner of this invention, which does contains ethylene-bis-stearamide.

Another useful aspect of the use of ethylene-bis-stearamide in this toner application is its ability to bring with it to surface other additives in toner to the surface. It was found that that high MW waxes which melt at a much higher temperature could now be brought to the toner surface when ethylene-bis-stearamide is present in the toner formulation. Owing to the higher melting temperatures, such waxes do not migrate to the toner surface when low molecular toner binders are used, as is the case with high speed digital color printers.

The present invention also relates to a developer containing the toner particles of the present invention.

The present invention further relates to a development system using the toner particles of the present invention.

The present invention also relates to a method of improving toner image sticking resistance using the above-identified toner formulation of the present invention.

The invention, and its objects and advantages, will become more apparent in the detailed description of the preferred embodiment presented below.

BRIEF DESCRIPTION OF THE DRAWINGS

In the detailed description of the preferred embodiment of the invention presented below, reference is made to the accompanying drawings, in which.

DETAILED DESCRIPTION OF THE INVENTION

Figure 1:
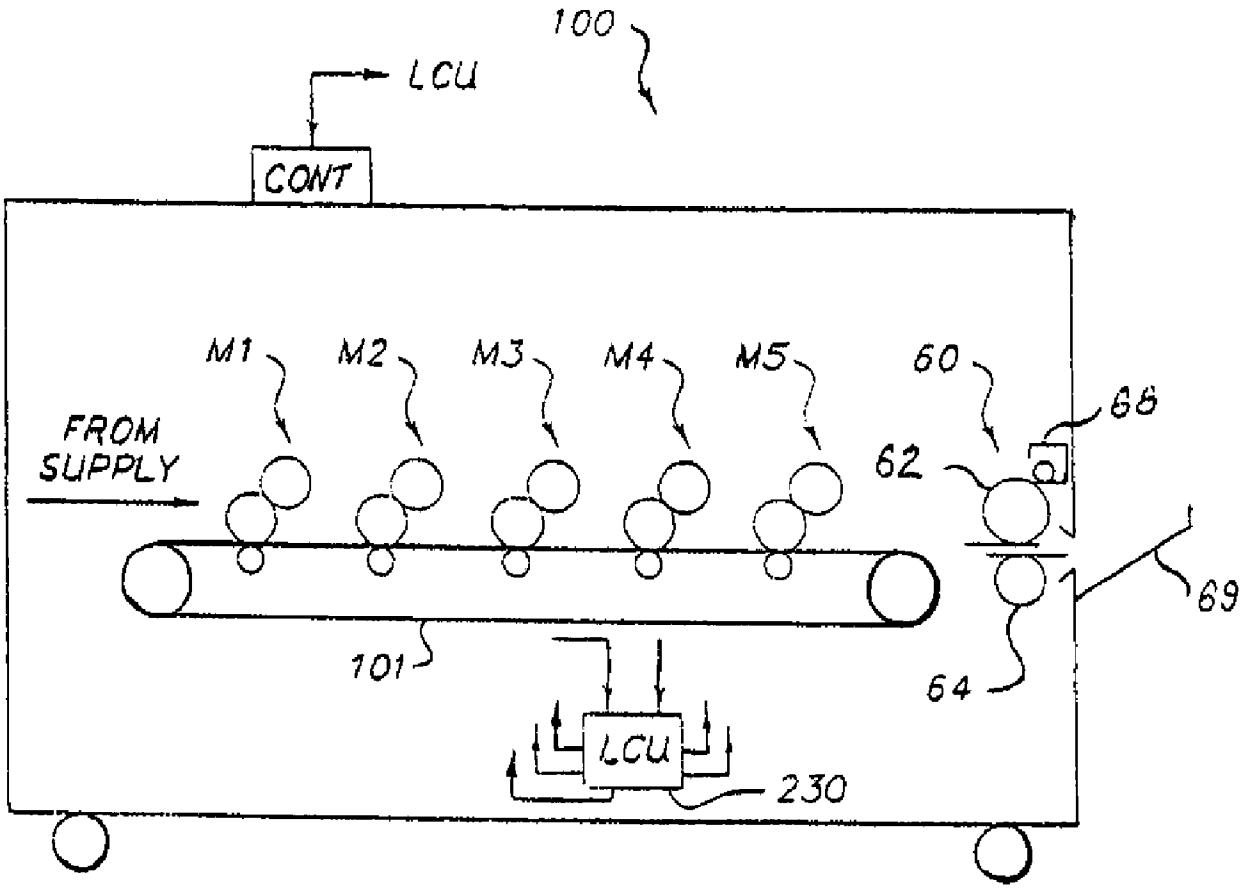
FIG. 1 is a schematic side elevational view, in cross-section, of a typical electrographic reproduction apparatus suitable for use with this invention.

In electrophotography, once the latent image has been developed and the developed image is then transferred to the substrate, it needs to be fixed in order for it to be well adhered to the substrate. This can be done by a number of means such as radiant heating or by passing the image through a pair of heated rollers. Of these, a pair of heated rollers is the most commonly used method for fixing an image. Generally, one of the rollers is heated to a higher temperature and may have an optional release fluid applied to its surface. The typical viscosity of the release fluid ranges from 200 cSt to 100,000 cSt at room temperature. For high-speed color applications, release fluid viscosity applied to this roller is typically less than 1000 cSt. This roller is usually referred to as the fuser roller. The other roller is typically heated to a much lower temperature and usually serves the function of applying pressure to the nip as the unfused image is passed through the nip of the two rollers. The second roller is typically referred to as a pressure roller. As the unfixed image is passed through a pair of heated rollers, the toner is softened as its temperature is increased on contact with the fuser roller. There is some spreading of the toner volume due to pressure and any void volume between toner particles is removed by the action of pressure and temperature. Unlike the off-set printing or ink jet applications, where most of the marking particles penetrate into the substrate fibers, the toner melt remains entirely above the paper substrate.

In a typical roller fusing step, a release fluid such as silicone oil is often used to eliminate and reduce any hot-off set of the image to the hot fuser roller surface. Since the color toners used in high speed digital printers have a low melt viscosity, the release fluids needs to be of even lower viscosity in order for them to function properly in assisting with release. When release fluids, such as silicone oils, have a melt viscosity of less than 1000 cSt, they tend to dissolve any low molecular olefinic or aliphatic additive in the toner. If any low molecular weight additive is thus used in a contact fusing roller nip, it will dissolve in the low viscosity release fluid. Although the solubility of these additives is small, it is sufficient to change dramatically the fluid viscosity of the release fluid. Also, when silicone oil is cooled, the oil containing even small amounts of such additive solidifies.

Various aliphatic and olefinic toner additives were first tested for solubility in silicone oil by adding 5 weight percent of these additives to the release fluid at 200° C. After testing various materials, it was discovered ethylene-bis-stearamide has limited or no solubility in fuser roller release fluid. Further, ethylene-bis-stearamide tends to migrate to the toner surface only following the fusing step. It also helps in bringing any other olefinic and aliphatric additive present in the toner with it to the top of the fused image.

It is thus easy to understand that if an aliphatic or olefinic additive is used in the toner, it should have limited solubility in the release fluid. It was found that olefinic wax materials have limited solubility in the silicone oil when the MW of the wax is equal to or greater than 2000 and also has a polydispersity of less than 2, where polydispersity is a number representing the ratio of the weight average molecular weight and the number average molecular weight of a polymeric substance as measured by Size Exclusion Chromatograph.

Improvement to the image sticking or blocking was measured by placing prints with or without the clear overcoat in an oven where the temperature of 55° C. and a RH of 95% was maintained. After evaluating various toners additives in toners and testing for sticking performance following a 24 hours exposure, it was determined that the optimum performance with an oiled fuser roller was found when:

i. toner binder has a glass transition temperature of equal to or greater than 60° C.;
ii. toner formulation contains 0.5 to 5 percent by weight of ethylene-bis-stearamide;
iii. toner formulation further contains an olefinic substance which has a molecular weight equal to or greater than 2000 and has a polydispersity of less than 2.

Preferably, the toner formulations of the present invention are used in two component toner/developer systems.

One or more toner resins may be present in the toner particles or toner formulations of the present invention. The toner particles can be any conventional size and preferably have a median volume diameter of from about 4 microns to about 30 microns. The toner binders employed in the protective and image marking toners can be any conventional polymeric resin or combination of resins typically used in toner formulations using conventional amounts, where the protective toner binder is selected to have a higher glass transition temperature than that of the image toner binder. The following discussion relates to optional components that can also be present in the toner particles or formulations employed in the present invention.

Useful amorphous polymers which can readily be fused to a conventional receiving sheet to form a permanent image generally have a glass transition temperature of less than or equal to about 100° C. Where other types of receiving elements are used, for example, metal plates such as certain printing plates, polymers having a glass transition temperature higher than the values specified above can be used. Preferably, toner particles prepared from these polymers have relatively high caking temperature, for example, higher than about 60° C., so that the toner powders can be stored for relatively long periods of time at fairly high temperatures without having individual particles agglomerate and clump together. In accordance with a specific embodiment of the invention, a protective toner formulation is employed whose binder has a glass transition temperature of at least 60° C., for use with marking particle toner which comprises a toner binder having a glass transition temperature less than 60° C. Such combination enables good anti-blocking performance, while also enabling relatively rapid and effective image fusing, by limiting use of a higher Tg toner binder to only the protective toner employed.

Among the various polymers which can be employed in the toner particles of the present invention are polycarbonates, resin-modified maleic alkyd polymers, polyamides, phenol-formaldehyde polymers and various derivatives thereof, polyester condensates, modified alkyd polymers, aromatic polymers containing alternating methylene and aromatic units such as described in U.S. Pat. No. 3,809,554 and fusible crosslinked polymers as described in U.S. Pat. No. Re. 31,072.

Useful binder polymers include vinyl polymers, such as homopolymers and copolymers of styrene. Styrene polymers include those containing 40 to 100 percent by weight of styrene, or styrene homologs, and from 0 to 40 percent by weight of one or more lower alkyl acrylates or methacrylates. Other examples include fusible styrene-acrylic copolymers that are covalently lightly crosslinked with a divinyl compound such as divinylbenzene. Preferred binders comprise styrene and an alkyl acrylate and/or methacrylate and the styrene content of the binder is preferably at least about 60% by weight.

Copolymers rich in styrene such as styrene butylacrylate and styrene butadiene are also useful as binders as are blends of polymers. In such blends, the ratio of styrene butylacrylate to styrene butadiene can be 10:1 to 1:10. Ratios of 5:1 to 1:5 and 7:3 are particularly useful. Polymers of styrene butylacrylate and/or butylmethacrylate (30 to 80% styrene) and styrene butadiene (30 to 90% styrene) are also useful binders. A useful binder can also be formed from a copolymer of a vinyl aromatic monomer; a second monomer selected from either conjugated diene monomers or acrylate monomers such as alkyl acrylate and alkyl methacrylate.

Styrene polymers include styrene, alpha-methylstyrene, para-chlorostyrene, and vinyl toluene; and alkyl acrylates or methylacrylates or monocarboxylic acids having a double bond selected from acrylic acid, methyl acrylate, 2-ethylhexyl acrylate, 2-ethylhexyl methacrylate, ethyl acrylate, butyl acrylate, dodecyl acrylate, octyl acrylate, phenylacrylate, methylacrylic acid, ethyl methacrylate, butyl methacrylate and octyl methacrylate and are also useful binders. Also useful are condensation polymers such as polyesters and copolyesters of aromatic dicarboxylic acids with one or more aliphatic diols, such as polyesters of isophthalic or terephthalic acid with diols such as ethylene glycol, cyclohexane dimethanol, and bisphenols.

Typical useful toner polymers include certain polycarbonates such as those described in U.S. Pat. No. 3,694,359, which include polycarbonate materials containing an alkylidene diarylene moiety in a recurring unit and having from 1 to about 10 carbon atoms in the alkyl moiety. Other useful polymers having the above-described physical properties include polymeric esters of acrylic and methacrylic acid such as poly(alkyl acrylate), and poly(alkyl methacrylate) wherein the alkyl moiety can contain from 1 to about 10 carbon atoms.

Additionally, other polyesters having the aforementioned physical properties are also useful. Among such other useful polyesters are copolyesters prepared from terephthalic acid (including substituted terephthalic acid), a bis[(hydroxyalkoxy)phenyl]alkane having from 1 to 4 carbon atoms in the alkoxy radical and from 1 to 10 carbon atoms in the alkane moiety (which can also be a halogen-substituted alkane), and an alkylene glycol having from 1 to 4 carbon atoms in the alkylene moiety.

Typically, the amount of toner resin present in the toner formulation is from about 85 to about 95. Various kinds of well-known addenda (e.g., colorants, release agents, etc.) can also be incorporated into the toners of the invention.

An optional additive for toner is a colorant. Numerous colorant materials selected from dyestuffs or pigments can be employed in the toner materials of the present invention. Such materials serve to color the toner and/or render it more visible. Of course, suitable toner materials having the appropriate charging characteristics can be prepared without the use of a colorant material where it is desired to have a developed image of low optical density. In those instances where it is desired to utilize a colorant, the colorants can, in principle, be selected from virtually any of the compounds.

Suitable dyes and pigments are disclosed, for example, in U.S. Reissue Pat. No. 31,072 and in U.S. Pat. Nos. 4,160,644; 4,416,965; 4,414,152; and 2,229,513, all incorporated in their entireties by reference herein. Colorants are generally employed in the range of from about 1 to about 30 weight percent on a total toner powder weight basis, and preferably in the range of about 2 to about 15 weight percent. The toner particles can include one or more toner resins which can be optionally colored by one or more colorants by compounding the resin(s) with at least one colorant and any other ingredients. Although coloring is optional, normally a colorant is included in image marking particles, and can be any of the materials mentioned in *Colour Index*, Volumes I and II, Second Edition, incorporated herein by reference. In some cases the magnetic component, if present, acts as a colorant negating the need for a separate colorant.

Colored marking toner employed in certain embodiments of the present invention comprises a toner binder selected to have a glass transition temperature lower than that of the protective toner employed. Preferably, the colored marking particle toner will comprises a toner binder having a glass transition temperature less than 60° C. (preferably from 50° C. to less than 60° C.), while the protective toner will comprise a toner binder having a Tg of at least 60° C. (preferably from 60° C. to 100° C.).

With respect to the additive that provides improved anti-sticking or blocking performance, incorporation of ethylene-bis-stearamide into the protective toner is essential. Ethylene-bis-stearamide was found to have limited solubility in fuser roller release fluids such as silicone oils. Further, its incorporation in toner does not affect the powder flow properties. The amount of ethylene-bis-stearamide for providing adequate print sticking resistance is preferably between about 0.5 and about 5%, more preferably between about 2.5 and about 5% by weight of the toner.

In addition, an optional olefinic or polyalkylene wax can also be used to provide additional print sticking resistance as well as improved abrasion protection. These polyalkylene waxes preferably have a number average molecular weight of about 2000 or higher. The polyalkylene wax, as indicated above, preferably has a polydispersity of 2.0 or lower to eliminate any solubility in the fuser roller release fluid. The polydispersity is a number representing the weight average molecular weight of the polyalkylene wax divided by the number average molecular weight of the polyalkylene wax.

In addition, the wax optionally employed in the present invention preferably has a melting temperature onset of from about 65° C. to about 130° C. The melting temperature onset is calculated by identifying the temperature at which a melting transition is exhibited first in a Differential Scanning Calorimeter (DSC) scan by showing a departure from the baseline. DSC scans were obtained using a Perkin Elmer DSC 7. A toner weight of 10 to 20 mg was used at a heating and cooling rate of 10° C. per minute.

Preferably, the wax that is present in the protective toner formulations of the present invention has all four of the above-described properties, or alternatively may only have one, two, or three of the properties in any combination.

Examples of suitable polyalkylene waxes include, but are not limited to, polyethylene or polypropylene, such as Peterolite Polywax 2000, Polywax 3000, Viscol 550 or 660 from Sanyo and the like. Also useful are ester waxes available from Nippon Oil and Fat under the WE-series waxes.

The amount of the polyalkylene wax that is present in the protective toner formulations of the present invention can be any suitable amount to accomplish the benefits mentioned herein. Examples of suitable amounts include, but are not limited to, from about 0.1 to about 10 weight percent and more preferably from about 1 to about 6 weight percent based on the toner weight. Other suitable amounts are from about 1 part to about 5 parts based on a 100 parts by weight of the toner resin present. Though not necessary, other conventional waxes can be additionally present, such as other polyolefin waxes and the like.

At least one charge control agent can be present in the toner formulations of the present invention. The term "charge-control" refers to a propensity of a toner addendum to modify the triboelectric charging properties of the resulting toner. A very wide variety of charge control agents for positive and negative charging toners are available. Suitable charge control agents are disclosed, for example, in U.S. Pat. Nos. 3,893,935; 4,079,014; 4,323,634; 4,394,430; and British Patent Nos. 1,501,065 and 1,420,839, all of which are incorporated in their entireties by reference herein. Additional charge control agents, which are useful, are described in U.S. Pat. Nos. 4,624,907; 4,814,250; 4,840,864; 4,834,920; 4,683,188; and 4,780,553, all of which are incorporated in their entireties by reference herein. Mixtures of charge control agents can also be used. Particular examples of charge control agents include chromium salicylate organo-complex salts, and azo-iron complex-salts, an azo-iron complex-salt, particularly ferrate (1-), bis[4-[(5-chloro-2-hydroxyphenyl)azo]-3-hydroxy-N-phenyl-2-naphthalenecarboxamidato(2-)], ammonium, sodium, and hydrogen (Organoiron available from Hodogaya Chemical Company Ltd.).

Additional examples of suitable charge control agents include, but are not limited to, acidic organic charge control agents. Particular examples include, but are not limited to, 2,4-dihydro-5-methyl-2-phenyl-3H-pyrazol-3-one (MPP) and derivatives of MPP such as 2,4-dihydro-5-methyl-2-(2,4,6-trichlorophenyl)-3H-pyrazol-3-one, 2,4-dihydro-5-methyl-2-(2,3,4,5,6-pentafluorophenyl)-3H-pyrazol-3-one, 2,4-dihydro-5-methyl-2-(2-trifluoromethylphenyl)-3H-pyrazol-3-one and the corresponding zinc salts derived therefrom.

Other examples include charge control agents with one or more acidic functional groups, such as fumaric acid, malic acid, adipic acid, terephathalic acid, salicylic acid, fumaric acid monoethyl ester, copolymers of styrene/methacrylic acid, copolymers of styrene and lithium salt of methacrylic acid, 5,5'-methylenedisalicyclic acid, 3,5-di-t-butylbenzoic acid, 3,5-di-t-butyl-4-hydroxybenzoic acid, 5-t-octylsalicylic acid, 7-t-butyl-3-hydroxy-2-napthoic acid, and combinations thereof. Still other acidic charge control agents which are considered to fall within the scope of the invention include N-acylsulfonamides, such as, N-(3,5-di-t-butyl-4-hydroxybenzoyl)-4-chlorobenzenesulfonamide and 1,2-benzisothiazol-3(2H)-one 1,1-dioxide.

Another class of charge control agents include, but are not limited to, iron organo metal complexes such as organo iron complexes. A particular example is T77 from Hodogaya.

Preferably, the charge control agent is capable of providing a charge. For purposes of the present invention, a preferred consistent level of charge is from about −30 to about −60 micro C/gm for a 8 micron volume average median particle size toner.

The charge control agent(s) is generally present in the toner formulation in an amount to provide a consistent level of charge and preferably provide a consistent level of charge of from about −30 to about −60 micro C/gm in the toner formulation upon being charged. Examples of suitable amounts include from about ½ part to about 6 parts per 100 parts of resin present in the toner formulation.

With respect to the surface treatment agent, also known as a spacing agent, the amount of the agent on the toner particles is an amount sufficient to permit the toner particles to be stripped from the carrier particles in a two component system by the electrostatic forces associated with the charged image or by mechanical forces. Preferred amounts of the spacing agent are from about 0.05 to about 1.5 weight percent, and more preferably from about 0.1 to about 1.0 weight percent, and most preferably from about 0.2 to 0.6 weight percent, based on the weight of the toner.

The spacing agent can be applied onto the surfaces of the toner particles by conventional surface treatment techniques such as, but not limited to, conventional powder mixing techniques, such as tumbling the toner particles in the presence of the spacing agent. Preferably, the spacing agent is distributed on the surface of the toner particles. The spacing agent is attached onto the surface of the toner particles and can be attached by electrostatic forces or physical means or both. With mixing, preferably uniform mixing is preferred and achieved by such mixers as a high energy Henschel-type mixer which is sufficient to keep the spacing agent from agglomerating or at least minimizes agglomeration. Furthermore, when the spacing agent is mixed with the toner particles in order to achieve distribution on the surface of the toner particles, the mixture can be sieved to remove any agglomerated spacing agent or agglomerated toner particles. Other means to separate agglomerated particles can also be used for purposes of the present invention. The mixing conditions should be gentle enough such that the large toner particles are not fractured by the collision with the wall of the Henschel mixer as they are agitated by the mixing blade/propeller. At too high a mixing speed, generation of fines particles is often observed with these larger toner particles owing to their large mass.

The preferred spacing agent is silica, such as those commercially available from Degussa, like R972, RY200 or from Wacker, like H2000. Other suitable spacing agents include, but are not limited to, other inorganic oxide particles and the like. Specific examples include, but are not limited to, titania, alumina, zirconia, and other metal oxides; and also polymer beads preferably less than 1 μm in diameter (more preferably about 0.1 μm), such as acrylic polymers, silicone-based polymers, styrenic polymers, fluoropolymers, copolymers thereof, and mixtures thereof. These metal oxide particles can be optionally treated with a silane or silicone coating to alter their hydrophobic character. In the preferred embodiment, a mixture of hydrophobic silica is used along with the hydrophobic titania to provide the optimum results for charging behavior and powder flow properties.

The toner formulations can also contain other additives of the type used in conventional toners, including magnetic pigments, colorants, leveling agents, surfactants, stabilizers, and the like.

In a typical manufacturing process, the desired polymeric binder for toner application is produced independently. Polymeric binders for electrostatographic toners are commonly made by polymerization of selected monomers followed by mixing with various additives and then grinding to a desired size range. During toner manufacturing, the polymeric binder is subjected to melt processing in which the polymer is exposed to moderate to high shearing forces and temperatures in excess of the glass transition temperature of the polymer. The temperature of the polymer melt results, in part, from the frictional forces of the melt processing. The melt processing includes melt-blending of toner addenda into the bulk of the polymer.

The melt product is cooled and then pulverized to a volume average particle size of from about 18 to 50 micrometers. It is generally preferred to first grind the melt product prior to a specific pulverizing operation. The grinding can be carried out by any convenient procedure. For example, the solid toner can be crushed and then ground using, for example, a fluid energy or jet mill, such as described in U.S. Pat. No. 4,089,472, and can then be classified in one or more steps. The size of the particles is then further reduced by use of a high shear pulverizing device such as a fluid energy mill.

In place of melt blending or the like, the polymer can be dissolved in a solvent in which the charge control agent and other additives are also dissolved or are dispersed. The resulting solution can be spray dried to produce particulate toner powders. Limited coalescence polymer suspension procedures as disclosed in U.S. Pat. No. 4,833,060 are particularly useful for producing small sized, uniform toner particles. The toner formulation may also be made using various chemical methods known in the toner industry. Other methods include those well-known in the art such as spray drying, melt dispersion, and dispersion polymerization.

The shape of the toner particles can be any shape, regular or irregular, such as spherical particles, which can be obtained by spray-drying a solution of the toner resin in a solvent. Alternatively, spherical particles can be prepared by the polymer bead swelling techniques, such as those described in European Patent No. 3905 published Sep. 5, 1979, which is incorporated in its entirety by reference herein.

To be utilized as toners in an electrostatographic developer, the toners of this invention can be mixed with a carrier vehicle. The carrier vehicles, which can be used with the present toners to form the new developer can be selected from a variety of materials. Such materials include carrier core particles and core particles overcoated with a thin layer of a film-forming resin.

The carrier core materials can comprise conductive, non-conductive magnetic, or non-magnetic materials. For example, carrier cores can comprise glass beads; crystals of inorganic salts such as aluminum potassium chloride; other salts such as ammonium chloride or sodium nitrate; granular zircon; granular silicon; silicon dioxide; hard resin particles such as poly(methyl methacrylate); metallic materials such as iron, steel, nickel, carborundum, cobalt, oxidized iron; or mixtures or alloys of any of the foregoing. See, for example, U.S. Pat. Nos. 3,850,663 and 3,970,571. Especially useful in magnetic brush development schemes are iron particles such as porous iron particles having oxidized surfaces, steel particles, and other "hard" or "soft" ferromagnetic materials such as gamma ferric oxides or ferrites, such as ferrites of barium, strontium, lead, magnesium, or aluminum. See, for example, U.S. Pat. Nos. 4,042,518; 4,478,925; and 4,546,060. The preferred hard magnetic carrier particles can exhibit a coercivity of at least about 300 gauss when magnetically saturated and also exhibit an induced magnetic moment of at least about 20 EMU/gm when in an externally applied field of 1,000 gauss. The magnetic carrier particles can be binder-less carriers or composite carriers. Useful hard magnetic materials include ferrites and gamma ferric oxide.

In one preferred embodiment, the carrier particles are composed of ferrites, which are compounds of magnetic oxides containing iron as a major metallic component. For example, compounds of ferric oxide, $Fe_2O_3$, formed with basic metallic oxides such as those having the general formula $MFeO_2$ or $MFe_2O_4$ wherein M represents a mono- or di-valent metal and the iron is in the oxidation state of +3. Preferred ferrites are those containing barium and/or strontium, such as $BaFe_{12}O_{19}$, $SrFe_{12}O_{19}$, and the magnetic ferrites having the formula $MO.6\ Fe_2O_3$ wherein M is barium, strontium, or lead as disclosed in U.S. Pat. No. 3,716,630 which is incorporated in its entirety by reference herein. The size of the magnetic carrier particles useful in the present invention can vary widely, and preferably have an average particle size of less than 100 microns, and more preferably have an average carrier particle size of from about 25 to about 50 microns.

As noted above, the carrier particles can be overcoated with a thin layer of a film-forming resin for the purpose of establishing the correct triboelectric relationship and charge level with the toner employed. Examples of suitable resins are the polymers described in U.S. Pat. Nos. 3,547,822; 3,632,512; 3,795,618; 3,898,170 and Belgian Pat. No. 797,132. Other useful resins are fluorocarbons such as polytetrafluoroethylene, poly(vinylidene fluoride), mixtures of these and copolymers of vinylidene fluoride and tetrafluoroethylene. See, for example, U.S. Pat. Nos. 4,546,060; 4,478,925; 4,076,857; and 3,970,571. Such polymeric fluorocarbon carrier coatings can serve a number of known purposes. One such purpose can be to aid the developer to meet the electrostatic force requirements mentioned above by shifting the carrier particles to a position in the triboelectric series different from that of the uncoated carrier core material, in order to adjust the degree of triboelectric charging of both the carrier and toner particles. Another purpose can be to reduce the frictional characteristics of the carrier particles in order to improve developer flow properties. Still another purpose can be to reduce the surface hardness of the carrier particles so that they are less likely to break apart during use and less likely to abrade surfaces (e.g., photoconductive element surfaces) that they contact during use. Yet another purpose can be to reduce the tendency of toner material or other developer additives to become undesirably permanently adhered to carrier surfaces during developer use (often referred to as scumming). A further purpose can be to alter the electrical resistance of the carrier particles. Examples of other suitable resin materials for the carrier particles include, but are not limited to, silicone resin, fluoropolymers, polyacrylics, polymethacrylics, copolymers thereof, and mixtures thereof, other commercially available coated carriers, and the like.

A typical developer containing the above-described toner and a carrier vehicle generally comprises from about 1 to about 25 percent by weight of particulate toner particles and from about 75 to about 99 percent by weight carrier particles. Usually, the carrier particles are larger than the toner particles. Conventional carrier particles have a particle size on the order of from about 20 to about 200 micrometers. For the preferred hard ferrite carrier particles, the volume average particle size should range from 15 to 60 microns.

Developers in the development system of the present invention are preferably capable of delivering toner to a charged image at high mass flow rates and hence are particularly suited to high-volume electrophotographic printing applications and copying applications.

The toner and developer described can be used in a variety of ways to develop electrostatic charge patterns or latent images. Such developable charge patterns can be prepared by a number of means and be carried for example, on a light sensitive photoconductive element or a non-light-sensitive dielectric-surfaced element such as an insulator-coated conductive sheet. One suitable development technique involves cascading the developer across the electrostatic charge pattern, while another technique involves applying toner particles from a magnetic brush. This latter technique involves the use of a magnetically attractable carrier vehicle in forming the developer. After imagewise deposition of the toner particles, the image can be fixed, e.g., by heating the toner to cause it to fuse to the substrate carrying the toner. If desired, the unfused image can be transferred to a receiver such as a blank sheet of copy paper and then fused to form a permanent image.

In more detail, such a set up of the development system is available in a digital printer, such as NexPress 3000 digital printer using a development station comprising a non-magnetic, cylindrical shell, a magnetic core, and means for rotating the core and optionally the shell as described, for instance, in detail in U.S. Pat. Nos. 4,473,029 and 4,546,060, both incorporated in their entirety herein by reference. The development systems described in these patents can be adapted for use in the present invention. In more detail, the development systems described in these patents preferably use hard magnetic carrier particles.

The present invention further relates to the use of the above-described development system in developing electrostatic images with the toner of the present invention. The method involves contacting an electrostatic image with the toner of the present invention. For example, the method involves developing an electrostatic image member hearing an electrostatic image pattern by moving the image member through a development zone and transporting developer through the development zone in developing relation with the charge pattern of the moving imaging member by rotating an alternating-pole magnetic core of a pre-selected magnetic field strength within an outer non-magnetic shell, which can be rotating or stationary, and controlling the directions and speeds of the core and optionally the shell rotations so that developer flows through the development zone in a direction co-current with the image member movement, wherein an electrographic two-component dry developer is preferably used. The dry developer contains charged toner particles and oppositely charged carrier particles.

The electrostatic image so developed can be formed by a number of methods such as by image-wise photo decay of a photoreceptor or image-wise application of a charge pattern on the surface of a dielectric recording element. When photoreceptors are used, such as in high-speed electrophotographic copy devices, the use of half-tone screening to modify an electrostatic image is particularly desirable; the combination of screening with development in accordance with the method of the present invention producing high-quality images exhibiting high Dmax and excellent tonal range. Representative screening methods include those employing photoreceptors with integral half-tone screen, such as those described in U.S. Pat. No. 4,385,823, incorporated in its entirety by reference herein.

Figure 2:
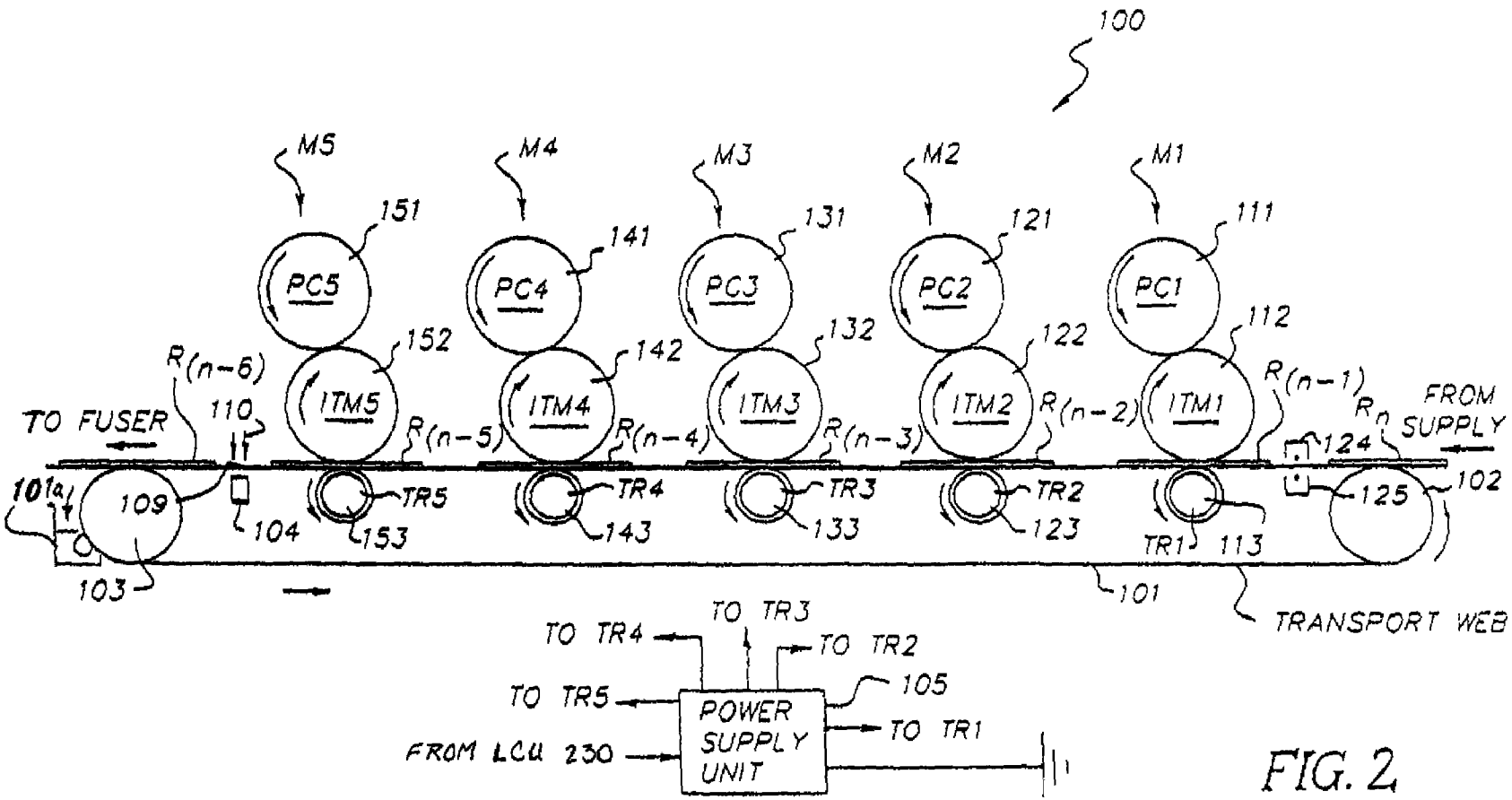
FIG. 2 is a schematic side elevational view, in cross-section, of the reprographic image-producing portion of the electrographic reproduction apparatus of FIG. 1, on an enlarged scale.
Figure 3:
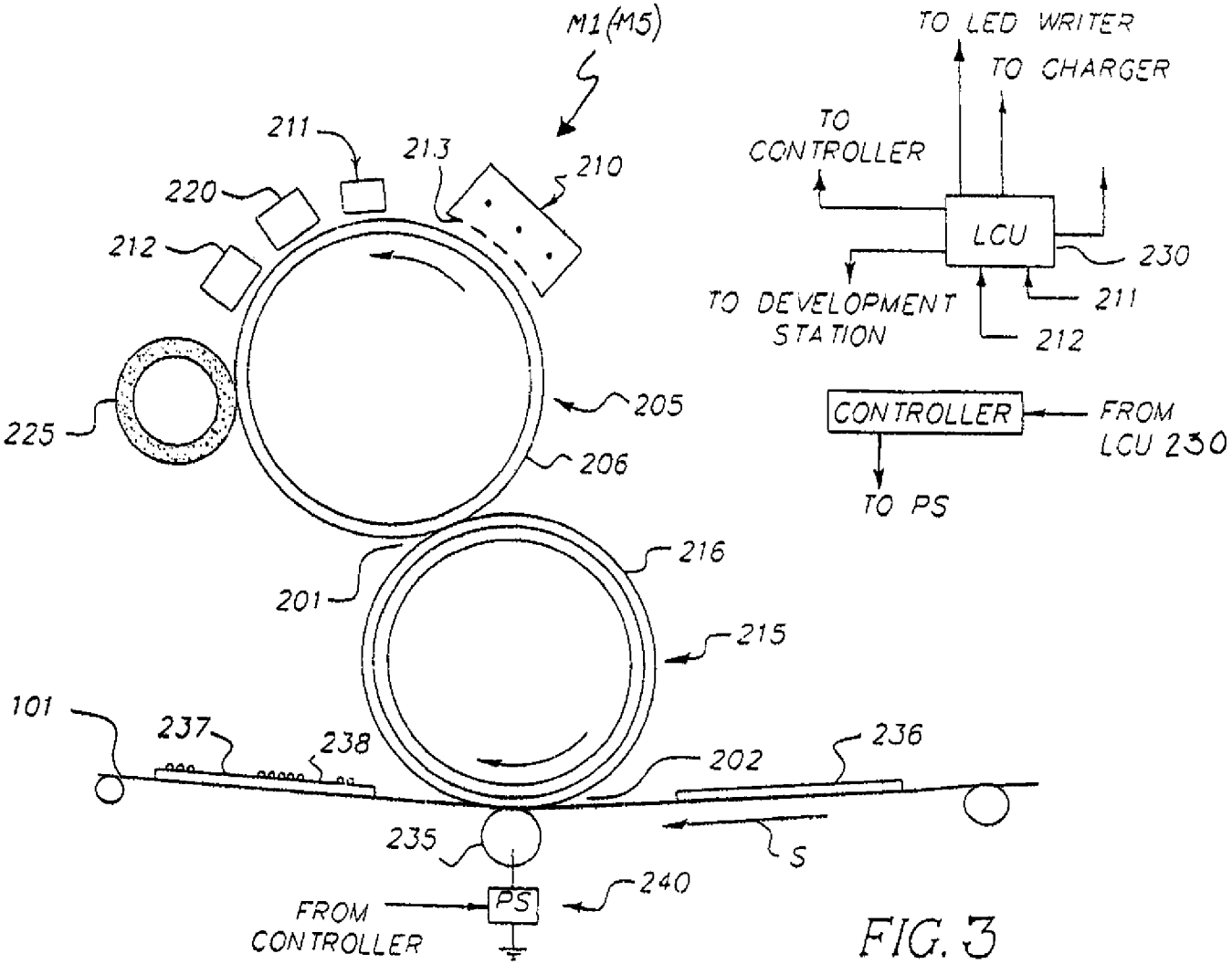
FIG. 3 is a schematic side elevational view, in cross-section, of one printing module of the electrographic reproduction apparatus of FIG. 1, on an enlarged scale.

Referring now to the accompanying drawings, FIGS. 1-3 are side elevational views schematically showing portions of a typical electrographic print engine or printer apparatus suitable for printing of pentachrome images. Although one embodiment of the invention involves printing using an electrophotographic engine having five sets of single color image producing or printing stations or modules arranged in tandem, the invention contemplates that more or less than five different toners may be combined on a single receiver member, or may include other typical electrographic writers or printer apparatus.

An electrographic printer apparatus 100 has a number of tandemly arranged electrostatographic image forming printing modules M1, M2, M3, M4, and M5. Each of the printing modules generates a single-color toner image or protective toner image for transfer to a receiver member successively moved through the modules. Each receiver member, during a single pass through the five modules, can have transferred in registration thereto up to five toner images to form a final composite image. An image formed on a receiver member may comprise combinations of subsets of the colors combined to form other colors on the receiver member at various locations on the receiver member, and all colors may participate to form process colors in at least some of the subsets wherein each of the colors may be combined with one or more of the other colors at a particular location on the receiver member to form a color different than the specific color toners combined at that location.

In a particular embodiment, printing module M1 forms black (K) toner color separation images, M2 forms yellow (Y) toner color separation images, M3 forms magenta (M) toner color separation images, and M4 forms cyan (C) toner color separation images. Printing module M5 may form a protective toner image (including a uniform protective toner layer) in accordance with the invention. It is well known that the four primary colors cyan, magenta, yellow, and black may be combined in various combinations of subsets thereof to form a representative spectrum of colors and having a respective gamut or range dependent upon the materials used and process used for forming the colors. However, in the electrographic printer apparatus, additional printing modules may also be employed, such that a fifth color can be added to improve the color gamut. In addition to adding to the color gamut, such additional printing modules may also be used as a specialty color toner image, such as for making proprietary logos.

Receiver members ($R_n$-$R_{(n-6)}$ as shown in FIG. 2) are delivered from a paper supply unit (not shown) and transported through the printing modules M1-M5. The receiver members are adhered (e.g., preferably electrostatically via coupled corona tack-down chargers 124, 125) to an endless transport web 101 entrained and driven about rollers 102, 103. Each of the printing modules M1-M5 similarly includes a photoconductive imaging roller, an intermediate transfer member roller, and a transfer backup roller. Thus in printing module M1, a black color toner separation image can be created on the photoconductive imaging roller PC1 (111), transferred to intermediate transfer member roller ITM1 (112), and transferred again to a receiver member moving through a transfer station, which transfer station includes ITM1 forming a pressure nip with a transfer backup roller TR1 (113).

Similarly, printing modules M2, M3, M4, and M5 include, respectively: PC2, ITM2, TR2 (121, 122, 123); PC3, ITM3, TR3 (131, 132, 133); PC4, ITM4, TR4 (141, 142, 143); and PC5, ITM5, TR5 (151, 152, 153). A receiver member, $R_n$, arriving from the supply, is shown passing over roller 102 for subsequent entry into the transfer station of the first printing module, M1, in which the preceding receiver member $R_{(n-1)}$ is shown. Similarly, receiver members $R_{(n-2)}$, $R_{(n-3)}$, $R_{(n-4)}$, and $R_{(n-5)}$ are shown moving respectively through the transfer stations of printing modules M2, M3, M4, and M5. An unfused image formed on receiver member $R_{(n-6)}$ is moving as shown towards a fuser of any well known construction, such as the fuser assembly 60 (shown in FIG. 1).

A power supply unit 105 provides individual transfer currents to the transfer backup rollers TR1, TR2, TR3, TR4, and TR5 respectively. A logic and control unit 230 (FIG. 1) includes one or more computers and in response to signals from various sensors associated with the electrophotographic printer apparatus 100 provides timing and control signals to the respective components to provide control of the various components and process control parameters of the apparatus in accordance with well understood and known employments. A cleaning station 101*a* for transport web 101 is also typically provided to allow continued reuse thereof.

With reference to FIG. 3 wherein a representative printing module (e.g., M1 of M1-M5) is shown, each printing module of the electrographic printer apparatus 100 includes a plurality of electrographic imaging subsystems for producing a single color toned image. Included in each printing module is a primary charging subsystem 210 for uniformly electrostatically charging a surface 206 of a photoconductive imaging member (shown in the form of an imaging cylinder 205). An exposure subsystem 220 is provided for image-wise modulating the uniform electrostatic charge by exposing the photoconductive imaging member to form a latent electrostatic color separation image of the respective color. A development station subsystem 225 serves for toning the image-wise exposed photoconductive imaging member with toner of a respective color. An intermediate transfer member 215 is provided for transferring the respective color separation image from the photoconductive imaging member through a transfer nip 201 to the surface 216 of the intermediate transfer member 215 and from the intermediate transfer member 215 to a receiver member (receiver member 236 shown prior to entry into the transfer nip and receiver member 237 shown subsequent to transfer of the toned color separation image) which receives the respective toned color separation images in superposition to form a composite multicolor image thereon.

Subsequent to transfer of the respective color separation images and protective toner, overlaid in registration, one from each of the respective printing modules M1-M5, the receiver member is advanced to a fusing assembly to fuse the multicolor toner image to the receiver member. Additional necessary components provided for control may be assembled about the various process elements of the respective printing modules (e.g., a meter 211 for measuring the uniform electrostatic charge, a meter 212 for measuring the post-exposure surface potential within a patch area of a patch latent image formed from time to time in a non-image area on surface 206, etc). Further details regarding the electrographic printer apparatus 100 are provided in U.S. Publication No. 2006/0133870, published on Jun. 22, 2006, in the names of Yee S. Ng et al.

Associated with the printing modules 200 is a main printer apparatus logic and control unit (LCU) 230, which receives input signals from the various sensors associated with the printer apparatus and sends control signals to the chargers 210, the exposure subsystem 220 (e.g., LED writers), and the development stations 225 of the printing modules M1-M5. Each printing module may also have its own respective controller coupled to the printer apparatus main LCU 230.

Subsequent to the transfer of the five toner images in superposed relationship to each receiver member, the receiver member is then serially de-tacked from transport web 101 and sent in a direction to the fusing assembly 60 to fuse or fix the dry toner images to the receiver member. The transport web is then reconditioned for reuse by cleaning and providing charge to both surfaces (see FIG. 2), which neutralizes charge on the opposed surfaces of the transport web 101.

The electrostatic image is developed by application of pigmented marking particles (toner) to the latent image bearing photoconductive drum by the respective development station 225. Each of the development stations of the respective printing modules M1-M5 is electrically biased by a suitable respective voltage to develop the respective latent image, which voltage may be supplied by a common power supply or by individual power supplies (not illustrated). Preferably, the respective developer is a two-component developer that includes toner marking particles and magnetic carrier particles.

Each development station has a particular color of pigmented toner marking particles, or non-pigmented (i.e., clear) protective toner particles, associated respectively therewith for toning. Thus, each of the five modules creates a different color marking particle image or protective toner image on the respective photoconductive drum. The development station of the clear toner printing module may have toner particles associated respectively therewith that are compatible with the toner marking particles of the color development stations, but employing a distinct toner binder and without the pigmented materials incorporated within the marking particles toner binder.

With further reference to FIG. 1, transport belt 101 transports the toner image carrying receiver members to a fusing or fixing assembly 60, which fixes the toner particles to the respective receiver members by the application of heat and pressure. More particularly, fusing assembly 60 includes a heated fusing roller 62 and an opposing pressure roller 64 that form a fusing nip there between. Fusing assembly 60 also includes a release fluid application substation generally designated 68 that applies release fluid, such as, for example, silicone oil, to fusing roller 62. The receiver members carrying the fused image are transported seriatim from the fusing assembly 60 along a path to either a remote output tray 69, or returned to the image forming apparatus to create an image on the backside of the receiver member (form a duplex print) for the purpose to be described below.

The logic and control unit (LCU) 230 includes a microprocessor incorporating suitable look-up tables and control software, which is executable by the LCU 230. The control software is preferably stored in memory associated with the LCU 230. Sensors associated with the fusing assembly provide appropriate signals to the LCU 230. In response to the sensors, the LCU 230 issues command and control signals that adjust the heat and/or pressure within fusing nip 66 and otherwise generally nominalizes and/or optimizes the operating parameters of fusing assembly 60 for imaging substrates.

Image data for writing by the printer apparatus 100 may be processed by a raster image processor (RIP), which may include a color separation screen generator or generators. The output of the RIP may be stored in frame or line buffers for transmission of the color separation print data to each of the respective LED writers K, Y, M, C, and CL (which stand for black, yellow, magenta, cyan, and red respectively and assuming that the fifth color is clear). The RIP and/or color separation screen generator may be a part of the printer apparatus or remote there from. Image data processed by the RIP may be obtained from a color document scanner or a digital camera or generated by a computer or from a memory or network which typically includes image data representing a continuous image that needs to be reprocessed into halftone image data in order to be adequately represented by the printer.

The RIP may perform image processing processes including color correction, etc. in order to obtain the desired color print. Color image data is separated into the respective colors and converted by the RIP to halftone dot image data in the respective color using matrices, which comprise desired screen angles and screen rulings. The RIP may be a suitably programmed computer and/or logic devices and is adapted to employ stored or generated matrices and templates for processing separated color image data into rendered image data in the form, of halftone information suitable for printing.

According to this invention, the desire to print protective toner, can be accomplished with an electrographic reproduction apparatus, such as the apparatus 100 discussed above, by controlling the amount of clear toner particles on a receiver member $R_n$ (see FIGS. 1-3). As discussed above, the protective clear over colored making particles can have various applications such as for example providing sticking resistance to prints when they are exposed to high temperature and humidity conditions, providing a smooth and uniform layer which is devoid of any differential gloss between high and low density areas. The toner of this invention can also be placed in selective areas to provide protection only where needed or to enhance the image in some manner.

When printing with protective toner in one of the electrographic modules, it may be advantageous to alter one or more electrographic process set-points, or operating algorithms, to optimize performance, reliability, and/or image quality of the resultant print. Examples of electrographic process set-point (or operating algorithms) values that may be controlled in the electrographic printer to alternate predetermined values when printing protective toner include, for example, imaging voltage on the photoconductive member, toner particle development voltage, transfer voltage and transfer current. In addition, the set-points of the fixing assembly may also be altered for printing protective toner, such as fusing temperature, fusing nip width, and fusing nip pressure. In an electrographic apparatus that produces prints with protective toner, a special mode of operation may be provided where the predetermined set-points (or control parameters or algorithms) are used when printing with such protective toner in the fifth module. That is, when the electrographic printing apparatus prints standard CYMK information images, a first set of set-points/control parameters are utilized. Then, when the electrographic printing apparatus changes mode to print protective toner overlay on images, a second set of set-points/control parameters are utilized.

Alternatively, several layers of the standard CYMK toner particles can be selectively covered in the desired amount of toner particles that provide protective feature. The protective toner particles are preferably clear (i.e., not pigmented) and have a lay down coverage of no more than 0.6 mg/cm$^2$. Optionally, these protective toner particles may comprise one or more pigments or other additives to impart special hue or appearance.

The protective toner can also be used to impart a desired, more overall background texture to the image, as described in U.S. Publication No. 2006/0187505, published on Aug. 24, 2006, in the names of Yee S. Ng et al. That is, using variable data, for example, from a database for the protective toner enables the variable data printing of images wherein the background texture may, for example, provide the appearance of a painter's canvas, an acrylic painting, a basketball (pigskin), sandstone, sandpaper, cloth, carpet, parchment, skin, fur, or wood grain. The resultant texture is preferably periodic, but can be random or unique. It is also preferable to create textures with a low frequency screening algorithm.

There are several ways in which fifth image data may be generated for using protective toner for printing. The fifth module image data can be generated by the digital front end (DFE) from original CMYK color data that uses the inverse mask technique of U.S. Pat. No. 7,139,521, issued Nov. 21, 2006, in the names of Yee S. Ng et al which is incorporated by reference. The inverse mask for protective printing is formed such that any rendered CMYK color pixel value with zero marking values will have a full strength (100%) fifth module pixel value generated. The fifth module image data is then processed with a halftone screen that renders a special texture. Accordingly, a special protective texture appearance will occur everywhere on the image (i.e., the foreground) where there is CMYK toner, but not in the background area.

In one alternative embodiment, a DFE can be utilized to store objects type information, such as text, line/graphics, or image types, to each rendered CYMK color pixel during raster image processing (RIPping). The fifth module imaging data will then be generated according to an operator's request for certain types of objects. For example, when only text object type is requested, the DFE will generate fifth image data only on the text object, while other object types will have zero values. This fifth image pixel will then be screened with halftone screens to generate the desired special texture. Here, the special texture will appear on the text objects while other objects will be nominal (non-textured) in appearance.

In another alternative embodiment, the operator selected fifth image spot with special texture appearance is formed on top of CMYK/RGB image objects. The DFE renders fifth channel image data accordingly and sends the data to the press for printing. A special halftone screen (for example, a contone screen) in the press is configured to screen the fifth image data. As a result, the special texture will be printed with protective toner that conforms to the operator's choice.

In all of these approaches, a clear toner may be applied on top of a color image to form a three-dimensional texture. It should be kept in mind that textural information corresponding to the clear toner image plane need not be binary. In other words, the quantity of clear toner called for, on a pixel by pixel basis, need not only assume either 100% coverage or 0% coverage; it may call for intermediate "gray level" quantities, as well.

In an area of the colored image to be covered with a clear toner for three-dimensional texture, the color may change due to the application of the clear toner. For this approach, two color profiles are created. The first color profile is for 100% clear toner coverage on top, and the second color profile is for 0% clear toner coverage on top. On a pixel by pixel basis, proportional to the amount of coverage called for in the clear toner image plane, a third color profile is created, and this third color profile interpolates the values of the first and second color profiles. Thus, a blending operation of the two color profiles is used to create printing values. In a preferred embodiment, a linear interpolation of the two color profile values corresponding to a particular pixel is performed. It is understood, however, that some form of non-linear interpolation may be used instead. This technique is especially useful when the spatial frequency of the clear toner texture is low.

The second approach may be used when the spatial frequency of the clear toner texture is high. In such case, only one color profile may be needed for that textured image. One option is to simply use the ICC color profile of the original system for all textures, i.e., the ICC color profile that assumes there is no clear toner. In such case, we simply accept the fact that the appearance of the colored image will change a bit since the absolute color will differ from the calibrated color. However, there will not be an observable color difference within a uniform color region, even though the color is not quite accurate. A second option is to build a new ICC color profile with that particular three-dimensional clear toner texture surface. In this manner, the macro "color accuracy" problem is corrected, while the color artifact from pixel-to-pixel is not noticeable. Furthermore, a library of such texture-modified ICC color profiles may be built up over time for use whenever an operator wishes to add a previously defined texture to a profile, as discussed above. A computer software application implementing such a system may, for the second approach, automatically invoke just one of these two options, or may instead display a choice of the two options to an operator, perhaps with one of the options being the default.

Sample Preparation and Testing

In order to make sure that toner additives can be used to provide protection it is important that they do not interfere with release fluid that is applied on to the fuser roller surface and do not degrade under the extremely high temperatures. Various aliphatic and olefinic materials were first added to silicone oils of various viscosities at 200° C. in a concentration of 5 percent by weight of the oil. After heating for 30 minutes, the samples were allowed to cool, and the silicone oil samples were visually inspected for any change in viscosity of the oil. It was found that when the silicone oil viscosity was very high, there was only a limited solubility of the aliphatic or olefinic toner additives. But as the viscosity of the oil was reduced to about less than 1000 cSt, the solubility of these toner additives in silicone oil increased. A number of such additives were then tested in 325 cSt silicone oil which also contained some mercapton functionalized silicone oil to the extent of 10% by weight. After the oil samples containing 5% toner additives were heated as described, they were cooled and the oil samples observed. The visual observations of the silicone oil samples are tabulated in TABLE 1. From these results it is evident that ethylene-bis-stearamide is one of the additives that does not have a large effect on fuser roller release fluid. Also, it was found that polyalkylene waxes which have molecular weight of equal to or greater than 2000 weight average molecular weight and a polydispersity of less than 2.0 also do not solubilize in silicone oils. It would appear that alkylene wax samples with polydispersity of greater than 2.0 have high enough portion of low molecular weight components to solubilize in the silicone oil on heating.

TABLE I

| Toner Additive | Polydispersity | Cooled silicone Oil Sample with 5% additive after 200° C. heating |
|---|---|---|
| None | | Liquid |
| Stearic Acid | | Solid |
| Stearamide | | Solid |
| Ethylene-bis-stearamide | | Liquid |

TABLE I-continued

| Toner Additive | Polydispersity | Cooled silicone Oil Sample with 5% additive after 200° C. heating |
|---|---|---|
| WE-3 Ester Wax | | Solid |
| WE-5 Ester Wax | | Solid |
| Carnauba Wax | >5 | Solid |
| Rice Wax | >5 | Solid |
| Baker Polywax 500 | >5 | Solid |
| Baker Polywax 1000 | >5 | Thick Liquid |
| Baker Polywax 2000 | 1.6 | Liquid |
| Baker Polywax 3000 | 1.5 | Liquid |
| Clariant Licowax PR 130 | 4.6 | Solid |
| Clariant Licowax PE 190 | 3.7 | Thick Liquid |

A mixture of toner ingredients were first dry powder blended in a 40 liter Henschel mixer for 60 seconds at 1000 RPM to produce a homogeneous blend. A bisphenol-A based polyester with a glass transition temperature (Tg) of 63° C. from Kao Chemicals Corporation, commercially available as Binder LLT 101, was used as the toner binder polymer and was mixed with 2 pph of Orient Chemicals Bontron E-84 charge agent. Aside from the control toner, which did not have additives incorporated to provide protection, toner had various amounts and combinations of various additives were also added to the dry blend. Corresponding toner samples were also similarly prepared using Atlac 382ES from Reichhold Chemicals as the toner binder, which has a Tg of 53° C.

The powder blend was then melt compounded in a twin screw co-rotating extruder to melt the polymer binder and disperse the pigments, charge agents, and waxes. Melt compounding was done at a temperature of 230° F. (110° C.) at the extruder inlet, 230° F. (110° C.) increasing to 385° F. (196° C.) in the extruder compounding zones, and 385° F., (196° C.) at the extruder die outlet. The processing conditions were a powder blend feed rate of 10 kg/hr and an extruder screw speed of 490 RPM. The cooled extrudate was then chopped to approximately ⅛ inch size granules.

After melt compounding, the granules were then fine ground in an air jet mill to the desired particle size of about 8 microns. The toner particle size distribution was measured with a Coulter Counter Multisizer and the medium volume weighted diameter was reported. The fine ground toner was then classified in a centrifugal air classifier to remove very small toner particles and toner fines that were not desired in the finished toner. After classification to remove fine particles, the toner had a fineness ratio, expressed as the ratio of the diameter at the 50% percentile to the 16% percentile of the cumulative particle number versus particle diameter, of 1.30 to 1.35.

The resulting mixture was pulverized to yield toner particles of sizes about 8 microns median volume weighted average diameter. The term "particle size" used herein, or the term "size" or "sized" as employed herein in reference to the term "particles", means the median volume weighted diameter as measured by conventional diameter measuring devices, such as a Coulter Multisizer, sold by Coulter, Inc. of Hialeah, Fla. Median volume weighted diameter is the diameter of an equivalent weight spherical particle which represents the median for a sample.

The classified toner was then surface treated with fumed silica. A hydrophobic silica, designated R972 and manufactured by Nippon Aerosil, was used. Subsequently, 2000 grams of toner were mixed with various amounts (grams) of each component to give a product containing different weight percent of each nanoparticle. The toner and silica were mixed in a 10 liter Henschel mixer with a 4 element impeller for 2 minutes at 2000 RPM. The silica surface treated toner was sieved through a 230 mesh vibratory sieve to remove undispersed silica agglomerates and any toner flakes that may have formed during the surface treatment process.

Thestoners comprising Binder LLT 101 from Kao Chemicals Corporation are identified in Table II, along with the additives used in the toner formulations.

TABLE II

| Sample | Toner Additive | Toner Powder Flow | Percent of Max Protective Overcoat on Image | Blocking damage following 55° C. 95% RH exposure |
|---|---|---|---|---|
| A | None | Good | | Extreme |
| B | 2.5% ethylene-bis-stearamide (EBS) | Good | 100 | Some damage |
| C | 5% EBS | Good | 100 | None |
| D | 2.5% Polywax 2000 | Poor | 100 | Some damage |
| E | 5% Polywax 2000 | Poor | 100 | Some damage |
| F | 10% Polywax 2000 | Poor | 100 | None |
| F | 2.5% EBS & 2.5% Polywax 2000 | Good | 100 | None |
| F | 2.5% EBS & 2.5% Polywax 2000 | Good | 50 | None |
| F | 2.5% EBS & 2.5% Polywax 2000 | Good | 25 | Some damage |
| C | 5% EBS | Good | 50 | None |
| C | 5% EBS | Good | 25 | Some Damage |

Tests Results with Incorporating Toner Examples

When toner samples were inspected for powder flow properties, it was found that the addition of olefinic or polyaklylene waxes adversely affect the powder flow properties. The powder flow measurements were made using Hasakawa Powder Flow tester. It may be possible to use other appropriate powder flow-testing devices that are prevalent in the powder industry. However, the addition ethylene-bis-stearamide does not affect the powder flow. In fact, as results indicate in TABLE II, the powder flow of the toner was improved when ethylene-bis-stearamide was used along with an polyalkylene wax, compared to use of the wax alone.

Electrographic developers are prepared by mixing toner for this invention as described above with hard magnetic ferrite carrier particles coated with polymeric resin(s). Developers are made at a concentration of 10 weight percent toner, and 90 weight percent carrier particles. Carriers employed herein are hard magnetic ferrite carrier particles coated with a mixtures of poly(vinylidene fluoride) and poly(methyl methacrylate).

Developers were further tested in a NexPress 3000 printer. Various color images were prepared from conventional CYMK toners comprising toner binder with Tg of 53 C, with a further protective toner overcoat. The amount of protective toner overcoat was varied as indicated in TABLE II. Images were tested for improvement in the sticking or blocking performance by placing them face-to-face in an oven for where the conditions were kept constant at 55° C. and 95% relative humidity under a load of 10 Pascals. After 24 hours, sample were removed and allowed to cool. After the sample had attained room temperature, the prints were separated and examined for damage. The results from the visual observations are summarized in TABLE II.

The print blocking results show that very good results are obtained when ethylene-bis-stearamide is present in the protective toner in an amount greater than 2.5% by weight of the toner. The amount of protective toner preferably is greater than 25% of maximum over the standard CYMK toners used to make color images to provide best results. Good blocking results were also obtained when a small amount of polyalkylene wax was also combined with ethylene-bis-stearamide without affecting the toner powder flow properties. Performance of comparison prints made with corresponding clear toner samples prepared using Atlac 382ES from Reichhold Chemicals (Tg of 53° C.) as the toner binder in place of the Binder LLT 101 from Kao Chemical (Tg of 63 C) was also evaluated, and found to provide relatively worse performance as evidenced by greater blocking damage being observed.

The invention has been described in detail with particular reference to certain preferred embodiments thereof, but it will be understood that variations and modifications can be effected within the spirit and scope of the invention.

What is claimed is:

1. A protective toner for digital printing wherein a protective overcoat can be printed by electrographic techniques, comprising a toner binder having a glass transition temperature of at least 60° C. and ethylene-bis-stearamide in an amount between 0.5 and 5 percent by weight of the toner, wherein the toner further contains an olefinic substance which has a weight average molecular weight equal to or greater than 2000 and has a polydispersity of less than 2.0, and the toner does not contain any colorant.

2. The toner according to claim 1, wherein the toner further comprise hydrophobic particles of silica and/or titania.

3. The toner according to claim 1, wherein the toner further comprises a wax-based release additive.

4. An electrographic developer comprising the toner of claim 1 and carrier particles.

5. The developer according to claim 4, wherein the carrier particles comprise magnetic particles.

6. The developer according to claim 4, wherein the carrier particles comprise a volume average particle size of less than 35 microns.

7. The developer according to claim 4, wherein the carrier particles comprise hard ferrites.

8. The developer according to claim 4, wherein the developer comprises a developer charge between −30 and −60 microcoulombs/gram.

9. A electrographic print comprising an image formed from marking toner and a protective toner overcoat deposited on a receiver member, said marking toner comprising a toner binder having a first glass transition temperature, and said protective toner overcoat comprising a toner binder having a second glass transition temperature greater than the glass transition temperature of the binder of the marking toner and ethylene-bis-stearamide in an amount between 0.5 and 5 percent by weight of the protective toner, wherein the second glass transition temperature is at least 60° C., and wherein the protective toner further contains an olefinic substance which has a weight average molecular weight equal to or greater than 2000 and has a polydispersity of less than 2.0, and the protective toner does not contain any colorant.

10. The print of claim 9, wherein said print comprises a protective toner selectively distributed over the image, having higher protective toner coverage in areas of said receiver member where blocking protection is desired.

11. The print of claim 9, wherein said print comprises a protective toner overcoat uniformly distributed over the image.

12. The print of claim 9, wherein the marking toner comprises a toner binder having a glass transition temperature of less than 60° C., and the protective toner overcoat comprises a toner binder having a glass transition temperature of at least 60° C.

13. The print of claim 12, said print capable of exhibiting face-to-face blocking protection at 55° C. and 95% relative humidity for up to 24 hours.

14. The print of claim 12, said print capable of exhibiting face-to-face blocking protection at 60° C. and 50% relative humidity for up to 24 hours.

15. A process for electrographic printing of an image with a protective toner overcoat, said electrographic printing comprising the steps of electrographically forming a desired print image on a receiver member utilizing marking toner comprising a toner binder having a glass transition temperature of less than 60° C., and electrographically forming a protective overcoat on the print image utilizing a protective toner comprising a toner binder having a glass transition temperature of at least 60° C. and ethylene-bis-stearamide in an amount between 0.5 and 5 percent by weight of the protective toner; and fixing the toner in the area of the formed print image where protection against blocking is desired, wherein the protective toner further contains an olefinic substance which has a weight average molecular weight equal to or greater than 2000 and has a polydispersity of less than 2.0, and the protective toner does not contain any colorant.

16. The process according to claim 15, wherein the step of fixing the toner is performed with a roller fuser employing a silicone oil release fluid.

17. The process according to claim 15 wherein the step of electrographically forming a desired print image on a receiver member utilizing marking toner comprises forming cyan, magenta, yellow and black toner color images, and the amount of protective toner is at least 40 percent of the maximum laydown possible for each of the colors.

18. The method according to claim 15 wherein the coverage of protective toner is less than 0.6 mg/cm$^2$.

* * * * *